US008807211B2

(12) United States Patent
Heijnen et al.

(10) Patent No.: US 8,807,211 B2
(45) Date of Patent: Aug. 19, 2014

(54) TOOL FOR SHUTTING OFF OPENINGS OR LEAKS IN A WELL BORE

(75) Inventors: Wilhelmus Hubertus Paulus Maria Heijnen, Stromberg (DE); Claire Dean, Bangalore (IN)

(73) Assignee: Maersk Olie OG Gas A/S, Copenhagen K (DK)

( * ) Notice: Subject to any disclaimer, the term of this patent is extended or adjusted under 35 U.S.C. 154(b) by 778 days.

(21) Appl. No.: 12/922,043

(22) PCT Filed: Mar. 11, 2009

(86) PCT No.: PCT/EP2009/052871

§ 371 (c)(1), (2), (4) Date: Mar. 22, 2011

(87) PCT Pub. No.: WO2009/112530

PCT Pub. Date: Sep. 17, 2009

(65) Prior Publication Data

US 2011/0162851 A1 Jul. 7, 2011

Related U.S. Application Data

(60) Provisional application No. 61/036,255, filed on Mar. 13, 2008.

(30) Foreign Application Priority Data

Mar. 13, 2008 (DK) ..... 2008 00388

(51) Int. Cl.

| | |
|---|---|
| ***E21B 33/127*** | (2006.01) |
| ***E21B 33/124*** | (2006.01) |
| ***E21B 33/12*** | (2006.01) |
| ***E21B 27/02*** | (2006.01) |
| ***E21B 33/13*** | (2006.01) |
| ***E21B 34/14*** | (2006.01) |

(52) U.S. Cl.

CPC ..... *E21B 33/1243* (2013.01); *E21B 33/1208* (2013.01); *E21B 27/02* (2013.01); *E21B 33/13* (2013.01); *E21B 34/14* (2013.01)

USPC ..... 166/187; 166/387; 166/277

(58) Field of Classification Search

CPC ..... E21B 34/06; E21B 34/14; E21B 33/12; E21B 33/127; E21B 33/00; E21B 33/128

USPC ..... 166/387, 187, 277, 212, 192, 373

See application file for complete search history.

(56) References Cited

U.S. PATENT DOCUMENTS

| | | | |
|---|---|---|---|
| 2,631,673 | A | 3/1953 | Halderson et al. |
| 2,769,498 | A | 11/1956 | Huber |

(Continued)

FOREIGN PATENT DOCUMENTS

| | | |
|---|---|---|
| EP | 0 819 830 A2 | 1/1988 |
| EP | 0898050 | 2/1999 |

(Continued)

OTHER PUBLICATIONS

<a href="http://www.thefreedictionary.com/common">common</a>.*

(Continued)

*Primary Examiner* — David Andrews
*Assistant Examiner* — Wei Wang
(74) *Attorney, Agent, or Firm* — Brinks Gilson & Lione

(57) ABSTRACT

A shutoff tool for being entered into a well bore and shutting off openings or leaks, said shutoff tool comprising: one or more enclosures prepared for comprising a sealant, said sealant being capable of shutting off openings or leaks when cured. An outer inflatable bladder arranged outside and covering said one or more enclosures, said outer inflatable bladder being prepared for rupturing in positions where it is not supported during inflation, said rupturing will provide access from said one or more enclosures to the outside of said outer inflatable bladder. An inner inflatable bladder arranged inside the outer inflatable bladder and such that said one or more enclosures will be arranged between the outer and the inner inflatable bladders, such that when inflated said inner inflatable bladder can exert a pressure on said one or more enclosures. A core arranged inside said inner inflatable bladder, and prepared for supplying a pressurized fluid into said inner inflatable bladder.

15 Claims, 3 Drawing Sheets

(56) References Cited

U.S. PATENT DOCUMENTS

| | | | | |
|---|---|---|---|---|
| 3,379,251 | A | 4/1968 | Bohn | |
| 3,727,691 | A | 4/1973 | Muecke et al. | |
| 4,064,941 | A | 12/1977 | Smith | |
| 4,417,625 | A | 11/1983 | Henson et al. | |
| 4,462,714 | A | 7/1984 | Smith | |
| 4,739,829 | A | 4/1988 | Brunner | |
| 4,913,232 | A * | 4/1990 | Cheymol et al. | 166/285 |
| 4,943,610 | A | 7/1990 | Sayles | |
| 4,972,906 | A | 11/1990 | McDaniel | |
| 5,028,213 | A | 7/1991 | Dickinson et al. | |
| 5,240,074 | A | 8/1993 | Peavy et al. | |
| 5,404,946 | A | 4/1995 | Hess | |
| 5,582,251 | A | 12/1996 | Bailey | |
| 6,196,315 | B1 | 3/2001 | Surles et al. | |
| 6,616,716 | B2 | 9/2003 | Hansen | |
| 6,848,519 | B2 | 2/2005 | Reddy et al. | |
| 6,955,216 | B1 | 10/2005 | Heijnen | |
| 7,306,033 | B2 * | 12/2007 | Gorrara | 166/187 |
| 7,523,785 | B2 | 4/2009 | Brink et al. | |
| 2001/0027868 | A1 | 10/2001 | Carisella | |
| 2006/0027371 | A1 * | 2/2006 | Gorrara | 166/313 |
| 2006/0102336 | A1 | 5/2006 | Campbell | |
| 2006/0144593 | A1 | 7/2006 | Reddy | |
| 2006/0185855 | A1 | 8/2006 | Jordan | |
| 2006/0234871 | A1 | 10/2006 | Dalrymple et al. | |
| 2007/0114016 | A1 | 5/2007 | Brezinski | |
| 2007/0209797 | A1 | 9/2007 | Brink et al. | |

FOREIGN PATENT DOCUMENTS

| | | | |
|---|---|---|---|
| EP | 1223303 | A1 | 7/2002 |
| EP | 1653042 | A1 | 5/2006 |
| EP | 1653043 | A1 | 5/2006 |
| GB | 2 153 409 | A | 8/1985 |
| GB | 2300015 | A | 10/1996 |
| WO | 2005078235 | | 8/2005 |
| WO | 2006008490 | | 1/2006 |
| WO | 2006084597 | A1 | 8/2006 |
| WO | WO 2006/079659 | A1 | 8/2006 |
| WO | 2007022834 | A1 | 3/2007 |
| WO | 2007101444 | | 9/2007 |
| WO | 2007124041 | | 11/2007 |
| WO | 9706346(A1) | | 6/2014 |

OTHER PUBLICATIONS

International Search Report and Written Opinion for PCT/EP2009/052871.

Kipp, Dale O., "Plastic Material Data Sheets," 2004; 2010, MatWeb, LLC.

International Search Report and Written Opinion for PCT/EP2009/052613, mailing date of Jul. 16, 2010.

International Search Report for PCT/EP2009/52554, mailed Jun. 8, 2009.

Written Opinion for PCT/EP2009/52554, mailed Jun. 8, 2009.

International Preliminary Report on Patentability for PCT/EP2009/52554, mailed May 25, 2010.

* cited by examiner

TOOL FOR SHUTTING OFF OPENINGS OR LEAKS IN A WELL BORE

RELATED APPLICATIONS

This application claims the benefit under 35 U.S.C. §371 of International Application No. PCT/EP2009/052871, filed Mar. 11, 2009, which claims priority to U.S. Provisional Application No. 61/036,255, filed Mar. 13, 2008 and Danish Application No. PA 2008 00388, filed Mar. 13, 2008, the contents of all of which are incorporated herein by reference in their entirety.

The invention relates to a shutoff tool for entering a well bore and shutting off openings or leaks.

The background for this invention.

Sliding sleeves (also called sliding side doors or SSDs) in a well bore sometimes become stuck in an open position and cannot be closed despite the application of hammering, bead blasting or acid spotting. If water or gas enters the wellbore through such a sleeve, it may be desirable to shut it off. The tool and the method could also be used for closing other openings or leaks. It is important that the tool does not significantly reduce the minimum internal diameter, leading to a restriction that could prevent subsequent well bore operations further along the well bore.

Tools for well bore operations with an inflatable bladder are known from WO 2006/084597 A1, where the inflatable bladder is used as a mould for displacement of cement. This kind of tool would, however, not be feasible for solving the problem mentioned above.

The above problem has been found to be solved by a shutoff tool comprising one or more enclosures prepared for comprising a sealant, said sealant being capable of shutting off openings or leaks when cured; further comprising an outer inflatable bladder arranged outside and covering said one or more enclosures, said outer inflatable bladder being prepared for rupturing in positions where it is not supported during inflation, said rupturing providing access from said one or more enclosures to the outside of said outer inflatable bladder; further comprising an inner inflatable bladder arranged inside the outer inflatable bladder and such that said one or more enclosures will be arranged between the outer and the inner inflatable bladders, such that pressure can be exerted on said one or more enclosures; further comprising a core arranged inside said inner inflatable bladder, and prepared for supplying a pressurised fluid into said inner inflatable bladder.

This tool has the advantage of being simple in operation and leaves minimum obstruction. Furthermore, it can be applied for all kind of openings or leaks.

In a further embodiment of the invention the core of the shutoff tool is arranged centrally inside said inner inflatable bladder, and is extending in a longitudinal direction.

In a preferred embodiment of the shutoff tool the sealant is epoxy, preferably a two compound epoxy, giving a strong and durable sealing of the opening.

In a further embodiment the one or more enclosures follow at least part of a helical pattern around said core, when said inner and outer bladders are inflated. Seen in a side view the enclosures will in this embodiment extend diagonally. This has the advantage of making it easier to position the tool.

The invention also concerns a method for shutting off openings or leaks, said method comprising the steps of: a) entering a tool according to any one of the previous claims into a well bore tubing; b) positioning said tool such that the inflatable bladder is at the position of the opening or leak to be shut off; c) pressurising said inner bladder through the core, whereby the two bladders are simultaneously inflated; d) pressing the outer bladder against the well-bore such that it covers the opening or leak; e) continuing to pump sealant through the one or more enclosures and increasing the pressure until the bladder ruptures, creating access to the opening or leak; f) continuing to pump such that sealant is pressed out through the ruptured portion of the bladder into the annular space surrounding the opening or leak; g) deflating the inner bladder, thereby allowing the tool to be removed from the well bore.

This method is relatively simple to perform and may be preferable to trying to shift sliding sleeves mechanically when it is suspected or known that they are stuck in place.

In a preferred embodiment of the method the sealant is a two-compound epoxy.

Embodiments of the invention are now described in further detail with reference to the drawings.

Figure 1:
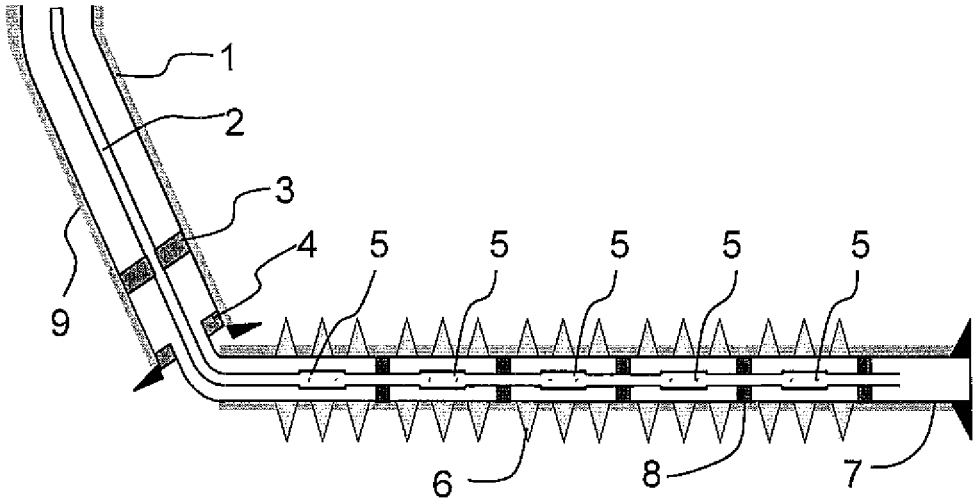
FIG. 1 illustrates a well bore.

FIG. 1 shows a schematic cross section of an example of a well bore having a casing 9, supported by cement 1, a tubing 2 running within the casing and being supported by a production packer and a series of isolation packers 8. The liner hanger 4 is arranged for supporting a reservoir liner 7. FIG. 1 further illustrates perforations 6 made though the liner and into the earth formation 20.

In this example, the tubing 2 provides a production conduit through which the oil and/or gas will flow. Isolation packers 8 are placed with some interval distance between the reservoir liner 7 and the tubing 2. The isolation packers 8 divide the annular space between the reservoir liner 7 and the tubing 2 into separate sections.

In the horizontal part of the well bore, sliding sleeve, 5 are arranged on the tubing 2. Each SSD 5 provides apertures or ports 15 through which the oil or gas can enter the tubing 2. These apertures can be closed or opened during operation of the well. They will for example be closed if a section of the reservoir between two packers 8 starts to produce water. In one embodiment, screens for removing sand particles from the fluid of oil and gas might be arranged on the outside of the SSD 5. The packers 8 prevent flow in the annular space between the tubing 2 and the reservoir liner 7. Such a flow could go from the zone around one SSD 5 to a neighbouring SSD 5. The element comprising the apertures or ports 15 is a standard element.

Figure 2:
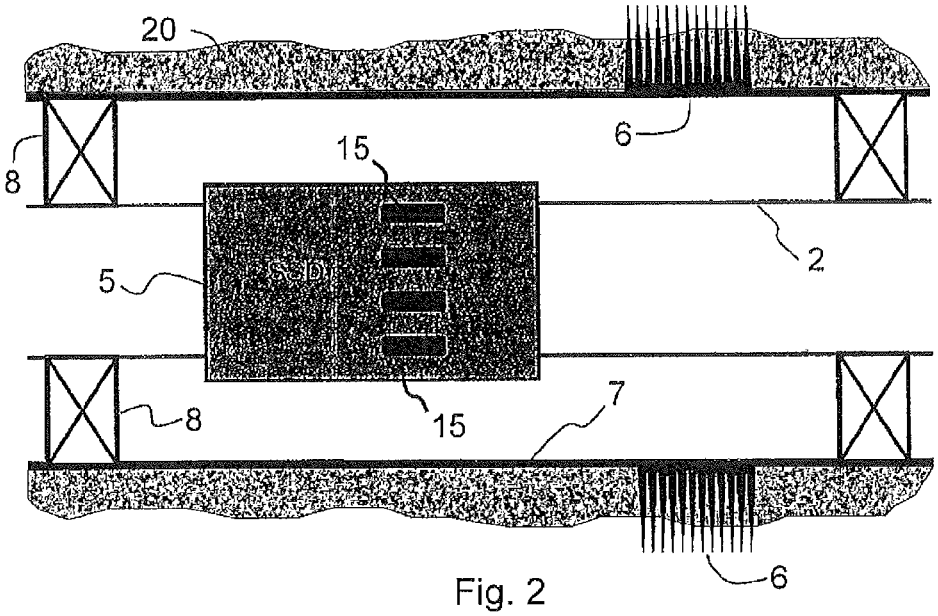
FIG. 2 illustrates a section of a well bore with a sliding sleeve.

FIG. 2 shows part of a well bore, i.e. one section delimited by isolation packers 8, and with one SSD 5. The SSD apertures 15 may be closed if, for example, the section starts producing water. However, sometimes an SSD 5 gets stuck and cannot be moved. If this happens in a fully or partly open position it may be necessary to shut off the SSD aperture 15.

Figure 3:
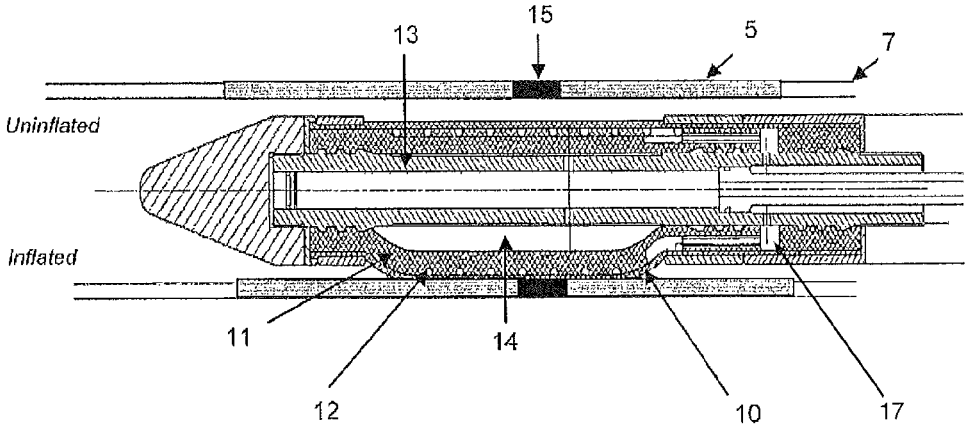
FIG. 3 illustrates the two part bladder in both un-inflated & inflated positions in a sliding sleeve.

The shutoff tool according to the invention can be applied in solving this problem by sealing off the SSD. A simple embodiment of the tool is shown in FIG. 3, where a two part inflatable bladder 10, 11 is shown in the SSD 5.

The idea with the tool according to the invention is that the tool can be run into the well bore in a deflated state. The two part inflatable bladder is positioned across the apertures or ports in the SSD. At this position, the inner inflatable bladder 11 is filled with hydraulic fluid 14, pumped through a core 13 until the outer inflatable bladder is pressed against the internal surface of the SSD.

Figure 4:
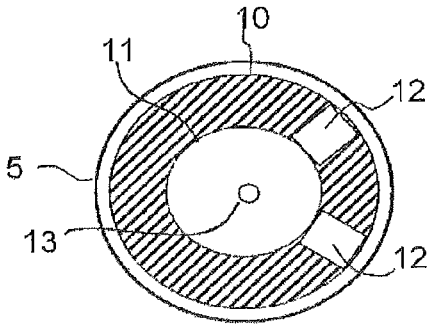
FIG. 4 illustrates a cross sectional view of the two part bladder of FIG. 3 with enclosures between the two bladders.
Figure 5:
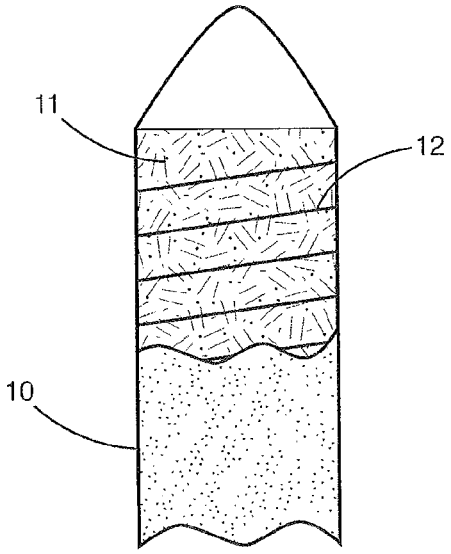
FIG. 5 illustrates another cross sectional view of the two-part bladder of FIG. 3.

Enclosures 12 or grooves for the sealant are arranged in the space formed between the inner and the outer inflatable bladder 11. An example of the arrangement of such enclosures 12 is illustrated in FIG. 4. After the inflation of the bladders, the sealant is injected into these enclosures 12 via one or more fluid passages 17 within the core until the outer bladder ruptures, forcing sealant into the SSD apertures. The pressure of the sealant will exceed the reservoir pressure.

The outer bladder, e.g. manufactured of rubber, another elastomeric material or metal sheet is designed such that it will rupture at the positions where it is not supported by the well tubular, i.e. where the apertures or ports of the SSD are positioned. It is also designed such that the rupture will establish a path from the enclosure and into the aperture of the SSD. The outer bladder ruptures when the pressure inside the enclosures 12 exceeds a certain level.

When the outer bladder ruptures at the position of the aperture of the SSD, the sealant will be forced from the enclosure and through the rupture into the SSD aperture. The injection of sealant continues while the inflation of the inner bladder is maintained, forcing sealant through the SSD apertures and into the surrounding annular space.

The diagonal orientation or part of a helical pattern of the enclosures or grooves between the two bladders facilitates that the sealant has a direct path through one of the SSD 5 apertures 15. The achievement of this direct path will be independent on the radial orientation of the shutoff tool due to this diagonal orientation or helical pattern. This orientation or pattern of the enclosures also provides a larger margin for error on depth positioning of the tool as compared to a radial enclosure arrangement.

A sealant suitable for this purpose could be an epoxy, preferably a two compound epoxy. The curing time of the sealing compound shall be selected according to the down hole conditions in the specific well bore. The sealing compound must be selected such that it has sufficient time to leave the enclosure in the tool and enter the annular space, but not sufficient time to slump before curing.

In order to ensure complete and uniform distribution of the sealing compound, the density of the sealing compound should be selected to match the density of the fluid in the annular space surrounding the sliding sleeve.

The inner inflatable bladder 11 must be inflated during curing of the sealant, in order to keep the outer inflatable bladder in position to prevent the sealant from entering to the inner side of the tubing.

When the sealing compound is sufficiently cured to keep the SSD aperture shut, the inner inflatable bladder shall be deflated, thereby allowing the shut-off tool to be retrieved from the well bore.

The outer inflatable bladder could be manufactured from or coated with a material to which the sealant will not adhere during curing. If the sealant is epoxy such material could be cured epoxy, polyethylene, paraffin wax petroleum jelly or wax paper. In another embodiment, the outer bladder could be designed such that it detaches from the tool and remains behind in the well-bore.

The invention claimed is:

1. A shutoff tool for being entered into a well bore and shutting off openings or leaks, said shutoff tool comprising:

one or more enclosures prepared for comprising a sealant, said sealant being capable of shutting off openings or leaks when cured, an outer inflatable bladder arranged outside and covering said one or more enclosures, said outer inflatable bladder is configured to rupture when a volume of sealant within an unsupported section of the outer inflatable bladder is increased, wherein a ruptured section of said outer inflatable bladder provides access from said one or more enclosures to an outside of said outer inflatable bladder, an inner inflatable bladder arranged inside the outer inflatable bladder such that said one or more enclosures will be arranged between the outer inflatable bladder and the inner inflatable bladder, such that when inflated said inner inflatable bladder can exert a pressure on said one or more enclosures, a core arranged inside said inner inflatable bladder, and prepared for supplying a pressurized fluid into said inner inflatable bladder, wherein the core comprises at least one fluid passage for providing a path for pumping sealant into said one or more enclosures.

2. The shutoff tool according to claim 1, wherein said core is arranged centrally inside said inner inflatable bladder, and extends in a longitudinal direction.

3. The shutoff tool according to claim 2, wherein said sealant is epoxy.

4. The shutoff tool according to claim 2, wherein said one or more enclosures follows at least part of a helical pattern around said core, when said inner inflatable bladder and outer inflatable bladder are inflated.

5. The shutoff tool according to claim 1, wherein said sealant is epoxy.

6. The shutoff tool according to claim 1, wherein said one or more enclosures is following at least part of a helical pattern around said core, when said inner inflatable bladder and outer inflatable bladder are inflated.

7. A method for shutting off openings or leaks, said method comprising the steps of:

providing a shutoff tool comprising:

one or more enclosures prepared for comprising a sealant, said sealant being capable of shutting off openings or leaks when cured, an outer inflatable bladder arranged outside and covering said one or more enclosures, said outer inflatable bladder is configured to inflate in a section where it is not supported and then rupture when said sealant is pumped into said enclosures, said rupturing will provide access from said one or more enclosures to an outside of said outer inflatable bladder, an inner inflatable bladder arranged inside the outer inflatable bladder such that said one or more enclosures will be arranged between the outer inflatable bladder and the inner inflatable bladder, such that when inflated said inner inflatable bladder can exert a pressure on said one or more enclosures, a core arranged inside said inner inflatable bladder, and prepared for supplying a pressurized fluid into said inner inflatable bladder, wherein the core comprises at least one fluid passage for providing a path for pumping sealant into said one or more enclosures;

inserting the shutoff tool into a well bore tubing;

positioning said shutoff tool such that the inner inflatable bladder is at a position of an opening or leak to be shut off;

pressurizing said outer inflatable bladder and inner inflatable bladder through the core to thereby press the outer inflatable bladder against the opening or leak;

pressing sealant into an enclosure of the one or more enclosures until the outer inflatable bladder ruptures, creating open access to the opening or leak pressing sealant to flow out of the enclosure and into the opening or leak;

deflating the inner inflatable bladder, thereby allowing the shutoff tool to be removed from the well bore.

8. The method according to claim 7, wherein said sealant is a two-compound epoxy.

9. The method according to claim 7, wherein said core is arranged centrally inside said inner inflatable bladder, and extends in a longitudinal direction.

10. The method according to claim 9, wherein said one or more enclosures follows at least part of a helical pattern around said core, when said inner inflatable bladder and outer inflatable bladder are inflated.

11. The method according to claim 9, wherein said sealant is a two-compound epoxy.

12. The method according to claim 7, wherein said one or more enclosures follows at least part of a helical pattern around said core, when said inner inflatable bladder and outer inflatable bladder are inflated.

13. A shutoff tool for being entered into a well bore and shutting off openings or leaks, said shutoff tool comprising:

an inner bladder positioned;

a core positioned within the inner bladder configured to supply a pressurized fluid into said inner bladder to thereby expand the inner bladder;

one or more enclosures that comprise a sealant that is configured to seal and opening, the one or more enclosures are positioned on an outer surface of the inner bladder;

an outer bladder arranged over the inner bladder and the one or more enclosures, wherein the outer bladder is configured to expand with the inner inflatable bladder, wherein the outer bladder is configured to expand in a section where it is not supported and then to rupture in regions where an outer surface of the outer bladder is not supported when the sealant within the one or more enclosures is pressurized, wherein the sealant flows out of the outer bladder through the rupture, wherein the core further comprises at least one fluid passage for providing a path for pumping sealant into said one or more enclosures.

14. The shutoff tool according to claim 13, wherein the outer bladder is formed of a common material.

15. The shutoff tool according to claim 13, wherein the one or more enclosures follow a helical pattern around the inner bladder.

* * * * *